US005269168A

United States Patent [19]

Ogawa

[11] Patent Number: 5,269,168

[45] Date of Patent: Dec. 14, 1993

[54] TRANSFER FEEDER

[75] Inventor: Masaaki Ogawa, Ishikawa, Japan

[73] Assignee: Kabushiki Kaisha Komatsu Seisakusho, Tokyo, Japan

[21] Appl. No.: 828,997

[22] PCT Filed: Jun. 11, 1991

[86] PCT No.: PCT/JP91/00782

§ 371 Date: Apr. 6, 1992

§ 102(e) Date: Apr. 6, 1992

[87] PCT Pub. No.: WO91/19576

PCT Pub. Date: Dec. 26, 1991

[30] Foreign Application Priority Data

Jun. 11, 1990 [JP] Japan ..... 2-60611[U]

[51] Int. Cl.[5] ..... B21D 43/05

[52] U.S. Cl. ..... 72/405; 198/621

[58] Field of Search ..... 72/405, 421; 198/621

[56] References Cited

U.S. PATENT DOCUMENTS

| | | | |
|---|---|---|---|
| 3,875,808 | 4/1975 | Okamoto | 72/405 |
| 4,785,657 | 11/1988 | Votava | 72/405 |
| 4,804,080 | 2/1989 | Baba | 198/621 |
| 4,819,786 | 4/1989 | Tanaka | 198/621 |

FOREIGN PATENT DOCUMENTS

| | | |
|---|---|---|
| 58-47324 | 3/1983 | Japan . |
| 61-60728 | 12/1986 | Japan . |

*Primary Examiner*—Daniel C. Crane

*Attorney, Agent, or Firm*—Armstrong, Westerman, Hattori, McLeland & Naughton

[57] ABSTRACT

It is an object of this invention to provide a transfer feeder wherein lift levers are pivoted to vertically move upstream and downstream lift beams through connecting rods and lift mechanisms to change their heights, and cross bars extend between transfer bars and are adapted to adjust the level of a workpiece to a plurality of different levels. The transfer feeder comprises a first feed height adjustment mechanism (25) disposed between the lift levers (22) and the connecting rods (28) to simultaneously change the height of the upstream lift beams ($7_1$) and the downstream lift beams ($7_2$) to respective levels, and a second feed height adjustment mechanism (30) disposed between the lift mechanisms (8) for the upstream lift beams ($7_1$) and the lift mechanisms (8) for the downstream lift beams ($7_2$) to change the height of the upstream lift beams relative to the upstream lift beams.

10 Claims, 2 Drawing Sheets

TRANSFER FEEDER

TECHNICAL FIELD OF THE INVENTION

This invention relates to a transfer feeder adapted to effect a change in the level of a workpiece to be fed.

BACKGROUND ART OF THE INVENTION

Conventionally, a transfer press includes a transfer feeder to transfer a workpiece to each working station or to transfer a workpiece to and from working stations.

The transfer feeder includes parallel transfer bars extending in the direction in which a workpiece is fed, and a plurality of cross bars extending between the transfer bars. The cross bars have workpiece holding means such as vacuum cups to transfer the workpiece when the transfer bars are moved in a two-dimensional manner.

When a working station is provided in the upstream side of the transfer feeder to perform a drawing operation, then it is necessary to change the level of a workpiece in response to drawing depths of products while it is being fed. It is also necessary to change the level of a workpiece when there is a difference in level between that fed in one station and that fed in the following station.

SUMMARY OF THE INVENTION

In view of the foregoing, it is an object of the present invention to provide a transfer feeder which can readily change the level of a workpiece to be fed.

In order to achieve the object, according to a preferred mode of the present invention, there is provided a transfer feeder comprising transfer bars extending in the direction in which a workpiece is fed from an upstream side to a downstream side and including cross bars at respective working stations, lift beams for supporting the transfer bars so that the transfer bars may be moved in the direction in which the workpiece is fed, the lift beams being divided into upstream lift beams and downstream lift beams, and lift mechanisms adapted to vertically move the lift beams by lift levers through connecting rod means, the lift levers being pivotally moved by lift cams mounted in cam boxes, characterized by a first feed height adjustment mechanism disposed between the lift levers and the connecting rod means to simultaneously change the height of the upstream lift beams and the downstream lift beams to respective levels, and a second feed height adjustment mechanism disposed between the lift mechanisms for the upstream lift beams and the lift mechanisms for the downstream lift beams to change the height of the upstream lift beams relative to the downstream lift beams.

A transfer press comprises a plurality of working stations. In such a transfer press, the transfer feeder of the present invention effects a change in the height of the lift beams located in an upstream working station and a downstream working station, respectively, so as to adjust the height of the cross bars to a plurality of different levels.

By this arrangement, when a drawing operation is performed in the upstream working station, the level of a workpiece can be changed in response to drawing depths or it can readily be changed if there is a difference in level between the workipiece fed in the drawing station and that fed in the following working station.

These and other objects, features and advantages of the present invention will become apparent to those skilled in the art by reference to the following description of a preferred embodiment as the principles of the present invention when taken in conjunction with the accompanying drawings.

DETAILED DESCRIPTION OF A PREFERRED EMBODIMENT

One embodiment of the present invention will now be described in detail in connection with the accompanying drawings.

Figure 1:
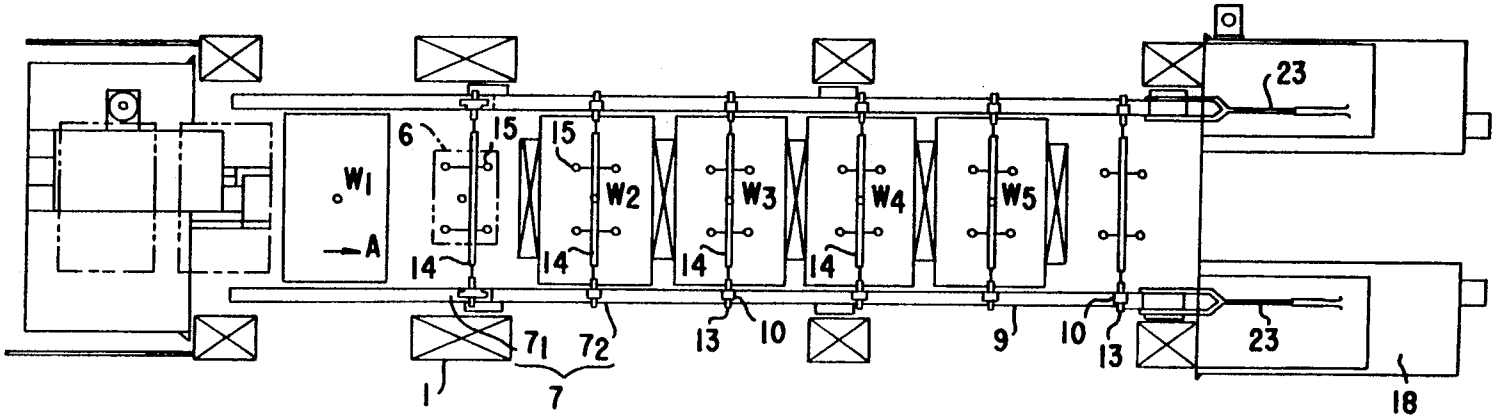
FIG. 1 is a schematic plan view of one embodiment of the present invention.
Figure 2:
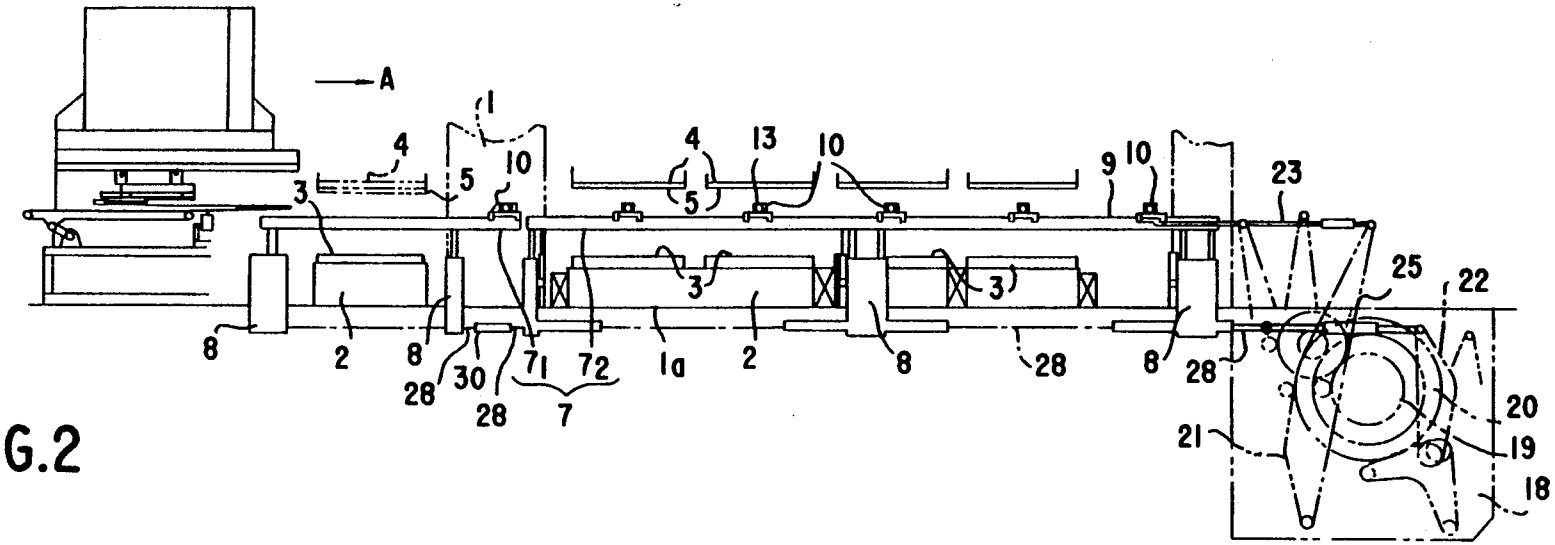
FIG. 2 is a schematic side view of the embodiment shown in FIG. 1.

In FIGS. 1 and 2, 1 is a press body. The press body 1 has a bed 1*a* on which a plurality of bolsters 2 are placed. Provided on the bolsters 2 are lower molds 3 at respective working stations $W_1$, $W_2$ and etc.

Slides 4 are located above the bolsters 2 and are free to reciprocate in a vertical direction. Upper molds 5 are attached to the lower surfaces of the slides 4 and cooperate with the lower molds 3 to process a workpiece 6 therebetween.

In the figures, 7 are a pair of parallel lift beams extending in a feed direction A. Each lift beam 7 on the bolster 2 is divided into an upstream lift beam $7_1$ and a downstream lift beam $7_2$. These lift beams $7_1$ and $7_2$ are each supported on lift mechanisms 8.

Guide rails (not shown) extend on and along the lift beams 7. The lift beams $7_1$ and $7_2$ include rollers (not shown) at their undersides to move on the guide rails in the feed direction A. A tilt mechanism 13 is arranged on each of the carriers 10. A cross bar 14 extends between opposite tilt mechanisms 13. Workpiece holding means 15 such as vacuum cups are mounted to the cross bars 14 to hold the workpiece 6.

In the figures, 18 are cam boxes placed at the downstream side in the feed direction A. Each cam box 18 houses a feed cam 19 and a lift cam 20. Power is fed from the press body 1 through a power takeoff unit, not shown, to rotate the feed cam 19 and the lift cam 20.

A feed lever 21 and a lift lever 22 are in sliding contact with the feed cam 19 and the lift cam 20 and have lower ends povitally supported. The upper ends of the levers 21, 22 are pivotally moved in the feed direction A upon rotation of the cams 19, 20.

The pivotal end of each feed lever 21 is connected through a link 23 to a carrier 10 located adjacent to the downstream end of the transfer feeder.

The pivotal end of the lift lever 22 is connected through a connecting rod 28 to a first feed height adjustment mechanism 25.

Figure 3:
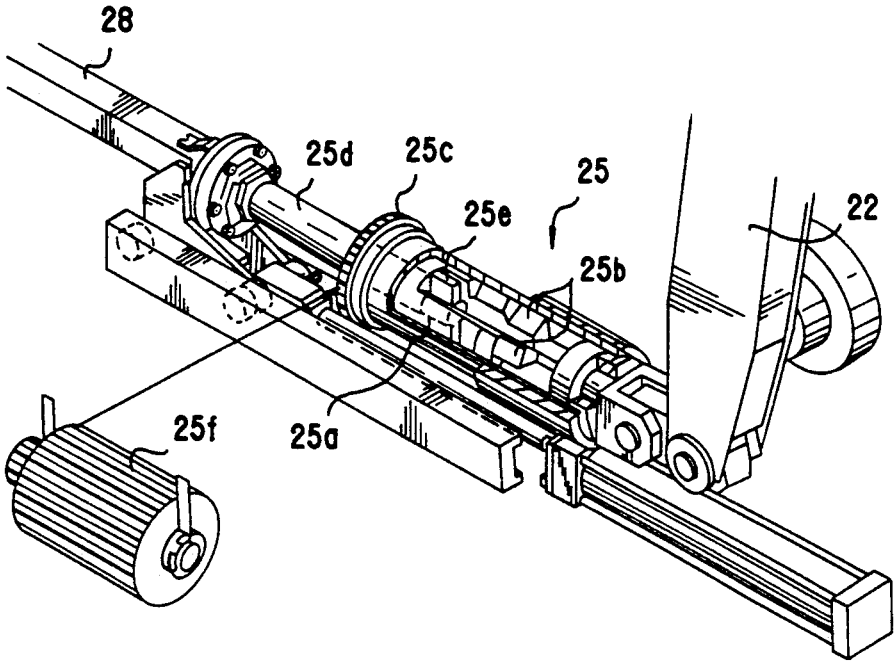
FIG. 3 is a perspective, partly broken away, of a feed height adjustment mechanism disposed between a lift lever and a lift mechanism.

As shown in FIG. 3, the first feed height adjustment mechanism 25 includes a rotary stopper 25*c*. The rotary stopper 25*c* has a plurality of stoppers 25*b* formed in a stepwise fashion and contained in a cylinder 25*a*. A stopper rod 25*d* extends into the rotary stopper 25*c* and has one end joined to the connecting rod 28.

The stopper rod 25d has a hook 25e at its other end. When the lift cam 20 is rotated to pivotally move the lift lever 22, and the rotary stopper 25c is rotated by a drive gear 25f, the hook 25e is brought into engagement with either one of the stoppers 25b to adjust the distance between the lift lever 22 and the connecting rod 28 in a stepwise fashion.

Each connecting rod 28 extends parallel to the downstream lift lever $7_2$ and toward the upstream lift lever and connected to the lift mechanisms 8 which is adapted to vertically move the downstream lift beam $7_2$. A second feed height adjustment mechanism 30 is arranged between the lift mechanisms 8 adapted to support the downstream lift beams $7_2$ and the lift mechanisms 8 adapted to support the upstream lift beams $7_1$ to change the height of the upstream lift beams $7_1$ and the downstream lift beams $7_2$.

Figure 4:
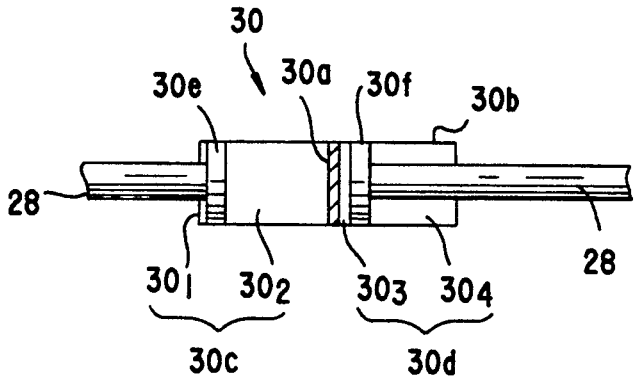
FIG. 4 is a sectional view of a feed height adjustment mechanism disposed between a lift mechanism for an upstream lift beam and a lift mechanism for a downstream lift beam.

As shown in FIG. 4, the second feed height adjustment mechanism 30 has a hydraulic cylinder 30b, and a partition located centrally in the hydraulic cylinder 30b to divide it into two oil chambers 30c, 30d. Pistons 30e, 30f are received in the oil chambers 30c, 30d, respectively.

The piston 30e is connected to the connecting rod 28 of the lift mechanism 8 adapted to vertically move the upstream lift beam $7_1$. The other piston 30f is connected to the connecting rod 28 of the lift mechanism 8 adapted to vertically move the downstream lift beam $7_2$. Four oil chambers $30_1$, $30_2$, $30_3$, $30_4$ are defined by the pistons 30e, 30f. Oil is selectively fed to these oil chambers to adjust the height of the upstream lift beam $7_1$ to four different levels relative to the downstream lift beam $7_2$.

Operation is as follows. The feed lever 21 and the lift lever 22 are pivotally moved by the feed cam 19 and the lift cam 20 contained in each cam box 18 to vertically move the lift beam 7. Also, the transfer bars 9 are reciprocated on the lift beams 7 in the feed direction A to subsequently transfer the workpiece 6 to the working stations $W_1$, $W_2$ and etc. The workpiece 6 is processed at these working stations $W_1$, $W_2$ and etc.

In order to simultaneously adjust the upstream lift beams $7_1$ and the downstream lift beams $7_2$ to the same level, each drive gear 25f is operable to rotate the rotary stopper 25c in the first feed height adjustment mechanism 25 disposed between the lift lever 22 and the connecting rod 28 so as to allow engagement of the hooks 25e with a selected one of the stoppers 25b. This permits the height of the upstream lift beams $7_1$ and the downstream lift beams $7_2$ to be adjusted to a plurality of different levels.

If a drawing operation is performed in the upstream working station $W_1$, it is necessary to adjust the level of the workpiece in response to drawing depths while it is being fed. If there is a difference in level between the workpiece fed in the drawing station and that fed in the second working station $W_2$ or subsequent working stations, it is also necessary to adjust the height of the upstream lift beams $7_1$ relative to the downstream lift beams $7_2$.

This adjustment is effected by the second feed height adjustment mechanism 30 located between the upstream lift beams $7_1$ of the lift mechanisms 8 and the downstream lift beams $7_2$.

As specifically shown in FIG. 4, oil is fed to either the oil chambers $30_2$ and $30_4$ or the oil chambers $30_1$ and $30_2$ to adjust the stroke at four different levels. This adjusts the height of the upstream lift beams $7_1$ relative to the downstream lift beams $7_2$ to four different levels.

I claim:

1. A transfer feeder comprising:

transfer bars extending in the horizontal direction, in which a workpiece is fed from an upstream side to a downstream side and including cross bars at respective work stations;

lift beams for supporting and vertically moving said transfer bars under the condition that said transfer bars may be moved in the direction, in which the workpiece is fed, said lift beams being divided into at least one upstream beam and at least one downstream beam; and a lifting mechanism adapted to vertically move said lift beams by at least one lifting lever through connecting rod means, said lifting lever being pivotally moved by at least one lift cam mounted in at least one cam box, said lifting mechanism including a first feed height adjustment mechanism disposed between said lifting lever and said connecting rod means to simultaneously change the height of said upstream lift beam and said downstream lift beam to respective levels, and a second feed height adjustment mechanism disposed between said lifting mechanism for adjusting relative position of said connecting rod means respectively corresponding to said upstream lift beam and said downstream lift beam and whereby to change the height of said upstream lift beam relative to said downstream lift beam with no relation to the movement of the transfer bars.

2. A transfer feeder comprising:

a transfer bar extending in the horizontal direction, along which a workpiece is fed from an upstream side to a downstream side;

a lift beam means supporting and vertically moving said transfer bar, allowing the movement of the transfer bar in a transferring direction, in which said workpiece is fed, said lift beam means including an upstream side first lift beam and a downstream side second lift beam separated from each other;

a lift mechanism cooperated with both of said first and second lift beams for adjusting height positions of both of said first and second lift beams in unison; and a relative height adjusting mechanism cooperated with said lift mechanism and adjusting the height position of said first lift beam relative to said second lift beam so that said first lift beam is adjusted to the height position by said lift mechanism in unison with said second lift beam while maintaining the adjusted relative height to said second lift beam with no relation to the movement of the transfer bar.

3. A transfer feeder comprising:

a transfer bar extending in the horizontal direction, along which a workpiece is fed from an upstream side and to a downstream side;

a lift beam means supporting and vertically moving said transfer bar, allowing the movement of the transfer bar in a transferring direction, in which said workpiece is fed, said lift beam means including an upstream side first lift beam and a downstream side second lift beam separated from each other;

a lift mechanism cooperated with both of said first and second lift beams for adjusting height positions of both of said first and second lift beams in unison; and a hydraulically relative height adjusting mechanism cooperated with said lift mechanism and adjusting the height position of said first lift beam relative to said second lift beam between a plurality of predetermined relative height positions so that said first lift beam is adjusted to the height position by said lift mechanism in unison with said second lift beam while maintaining the adjusted relative height to said second lift beam with no relation to the movement of the transfer bar.

4. A transfer feeder comprising:

transfer bar extending in a horizontal direction, along which a workpiece is fed from an upstream side and to a downstream side;

a lift beam means supporting and vertically moving said transfer bar, allowing the movement of the transfer bar in a transferring direction, in which said workpiece is fed, said lift beam means including an upstream side first lift beam and a downstream side second lift beam separated from each other;

a lift mechanism cooperated with both of said first and second lift beams for adjusting height positions of both of said first and second lift beams in unison; and a relative height adjusting mechanism cooperated with said lift mechanism and adjusting the height position of said first lift beam relative to said second lift beam between a plurality of predetermined relative height positions so that said first lift beam is adjusted to the height position by said lift mechanism in unison with said second lift beam while maintaining the adjusted relative height to said second lift beam with no relation to the movement of the transfer bar.

5. A transfer feeder comprising:

transfer bar extending in a horizontal direction, along which a workpiece is fed from an upstream side and to a downstream side;

a lift beam means supporting and vertically moving said transfer bar, for movement of the transfer bar in a transferring direction, in which said workpiece is fed, said lift beam means including an upstream side first lift beam and a downstream side second lift beam separated from each other;

a lift mechanism cooperated with both of said first and second lift beams for adjusting height positions of both of said first and second lift beams in unison; and a relative height adjusting mechanism cooperated with said lift mechanism and adjusting the height position of said first lift beam relative to said second lift beam so that said first lift beam is adjusted to the height position by said lift mechanism in unison with said second lift beam while maintaining the adjusted relative height to said second lift beam with no relation to the movement of the transfer bar.

6. A transfer feeder as set forth in claim 3, wherein said lift mechanism includes a first actuation member associated with said first lift beam for driving the first lift beam to a first desired height position and a second actuation member associated with said second lift beam for driving the second lift beam to a second desired height position, and said relative height adjusting mechanism comprises a hydraulic cylinder incorporating two pistons disposed therein and respectively connected to said first and second actuation members for adjusting relative position of said first and second actuation members for adjusting height difference between said first and second desired height position in proportion thereto.

7. A transfer feeder as set forth in claim 6, wherein said cylinder defines mutually separated two fluid chambers, in which said pistons are respectively disposed for separating each fluid chamber into respectively two sub-chambers, the fluid pressure in each of said sub-chambers being adjustable for establishing relative height difference between said first and second desired height positions of said first and second lift beams.

8. A transfer feeder as set forth in claim 3, wherein said lift mechanism includes a first actuation member associated with said first lift beam and reciprocally movable in a perpendicular direction to the lifting direction of said first lift beam and a first lift means responsive to the stroke position of said first actuation member for driving the latter to a first desired height position corresponding to the stroke position of said first actuation member and a second actuation member associated with said second lift beam and reciprocally movable in a perpendicular direction to the lifting direction of said second lift means and a second lift means responsive to the stroke position of said second actuation member for driving the second actuation member to a second desired height position corresponding to the stroke position of said second actuation member, and said relative height adjusting mechanism comprises a hydraulic cylinder incorporating two pistons disposed therein and respectively connected to said first and second actuation members for adjusting differentiating said stroke positions of said first and second actuation members for adjusting height difference between said first and second desired height position in proportion thereto.

9. A transfer feeder as set forth in claim 8, wherein said cylinder defines mutually separated two fluid chambers, in which said pistons are respectively disposed for separating each fluid chamber into respectively two sub-chambers, the fluid pressure in each of said sub-chambers being adjustable for establishing relative height difference between said first and second desired height positions of said first and second lift beams.

10. A transfer feeder as set forth in claim 8, wherein said first and second actuation members are arranged in alignment with each other and, said relative height adjusting mechanism is disposed therebetween.

* * * * *